US006045343A

United States Patent [19]

Liou

[11] Patent Number: 6,045,343

[45] Date of Patent: Apr. 4, 2000

[54] INTERNALLY COOLING ROTARY COMPRESSION EQUIPMENT

[75] Inventor: Ding-Guey Liou, Taipei Hsien, Taiwan

[73] Assignee: Sunny King Machinery Co., Ltd., Taipei Hsien, Taiwan

[21] Appl. No.: 09/007,340

[22] Filed: Jan. 15, 1998

[51] Int. Cl.[7] ..... F01C 21/04

[52] U.S. Cl. ..... 418/91; 418/94; 418/201.1

[58] Field of Search ..... 418/91, 201.1, 418/94

[56] References Cited

U.S. PATENT DOCUMENTS

| | | | |
|---|---|---|---|
| 3,535,057 | 10/1970 | Kodra | 418/201.1 |
| 5,292,237 | 3/1994 | Orimo et al. | 418/94 |
| 5,417,551 | 5/1995 | Abe et al. | 417/203 |
| 5,924,855 | 7/1999 | Dahmlos et al. | 418/91 |

FOREIGN PATENT DOCUMENTS

| | | | |
|---|---|---|---|
| 406159280 | 6/1994 | Japan | 418/201.1 |

*Primary Examiner*—Thomas Denion
*Assistant Examiner*—Theresa Trieu

[57] ABSTRACT

A rotary compression equipment includes: a housing having at least two intermeshing hollow rotors rotatably mounted in the housing by two shafts, each rotor formed with a hollow portion for passing a coolant in the hollow portion for cooling the meshing rotors when rotated, and a coolant passage formed in each shaft and fluidically communicated with the hollow portion in the rotor for leading coolant from the coolant passage into the hollow portion in the rotor for removing heat of the rotors outwardly for reducing thermal expansion of the rotary equipment and increasing the efficiency of the rotary equipment.

3 Claims, 4 Drawing Sheets

INTERNALLY COOLING ROTARY COMPRESSION EQUIPMENT

BACKGROUND OF THE INVENTION

U.S. Pat. No. 4,983,107 (hereinafter called "prior art") to Steffens et al. disclosed a multistage rotary piston vacuum pump including a cooling system provided to reduce too intensive heating and thus expansion of the rotary pistons (4, 5) having two shafts (2, 3) extended downwardly with blind bores (73, 74) longitudinally formed in the two shafts (2, 3) and coolant flowing through the bores (73, 74) for cooling the shafts; and each rotor (4–9) being made of claw type having a ceramic claw (66) secured to an ironic central body (65) by screw (67) for radiating heat for less radial expansion.

However, the rotary pump of Steffens et al. still has the following drawbacks:

1. The shafts (2, 3) should be vertically erected in order to gravitationally return the coolant after absorbing the heat, thereby limiting the installation choices and influencing the piping arrangement of the whole fluid delivery system.

2. The coolant does not enter the internal portion of the pistons (4, 5) and only flows through the bores (73, 74) for merely dissipating heat of the central portion of the pistons (4, 5) near the shafts (2, 3), unable for efficiently removing heat from the pistons.

3. The ceramic claw (66) as fixed on the central body (65) of the rotor may be easily loosened or separated to damage the pump.

The present inventor has found the drawbacks of the conventional rotary vacuum pump, and invented the present rotary compression equipment as internally cooled.

SUMMARY OF THE INVENTION

The object of the present invention is to provide a rotary compression equipment including: a housing having at least two intermeshing hollow rotors rotatably mounted in the housing by two shafts, each rotor formed with a hollow portion for passing a coolant in the hollow portion for cooling the meshing rotors when rotated, and a coolant passage formed in each shaft and fluidically communicated with the hollow portion in the rotor for leading coolant from the coolant passage into the hollow portion in the rotor for removing heat of the rotors outwardly for reducing thermal expansion of the rotary equipment and increasing the efficiency of the rotary equipment.

DETAILED DESCRIPTION

Figure 1:
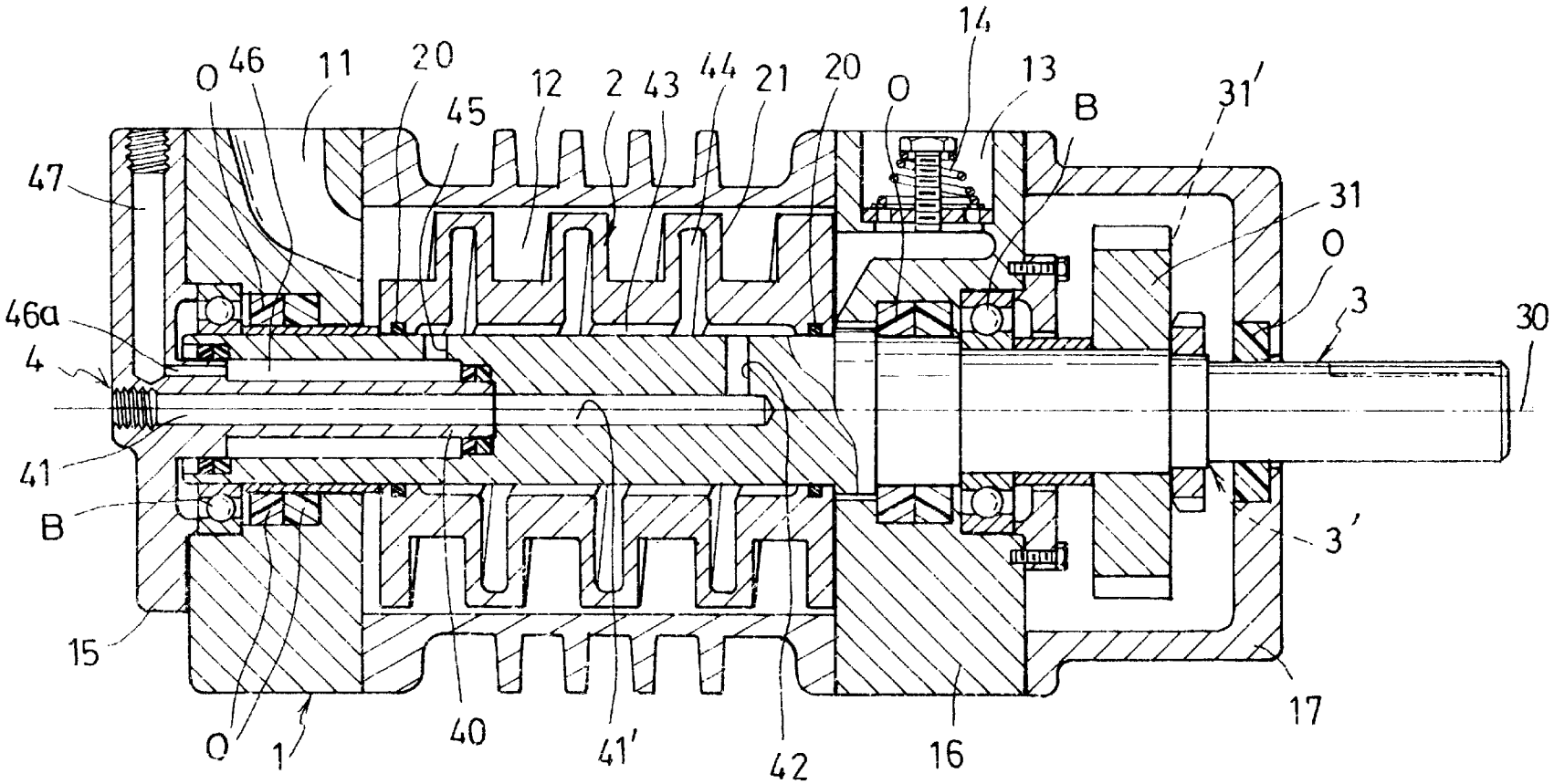
FIG. 1 is a sectional drawing of the present invention.
Figure 2:
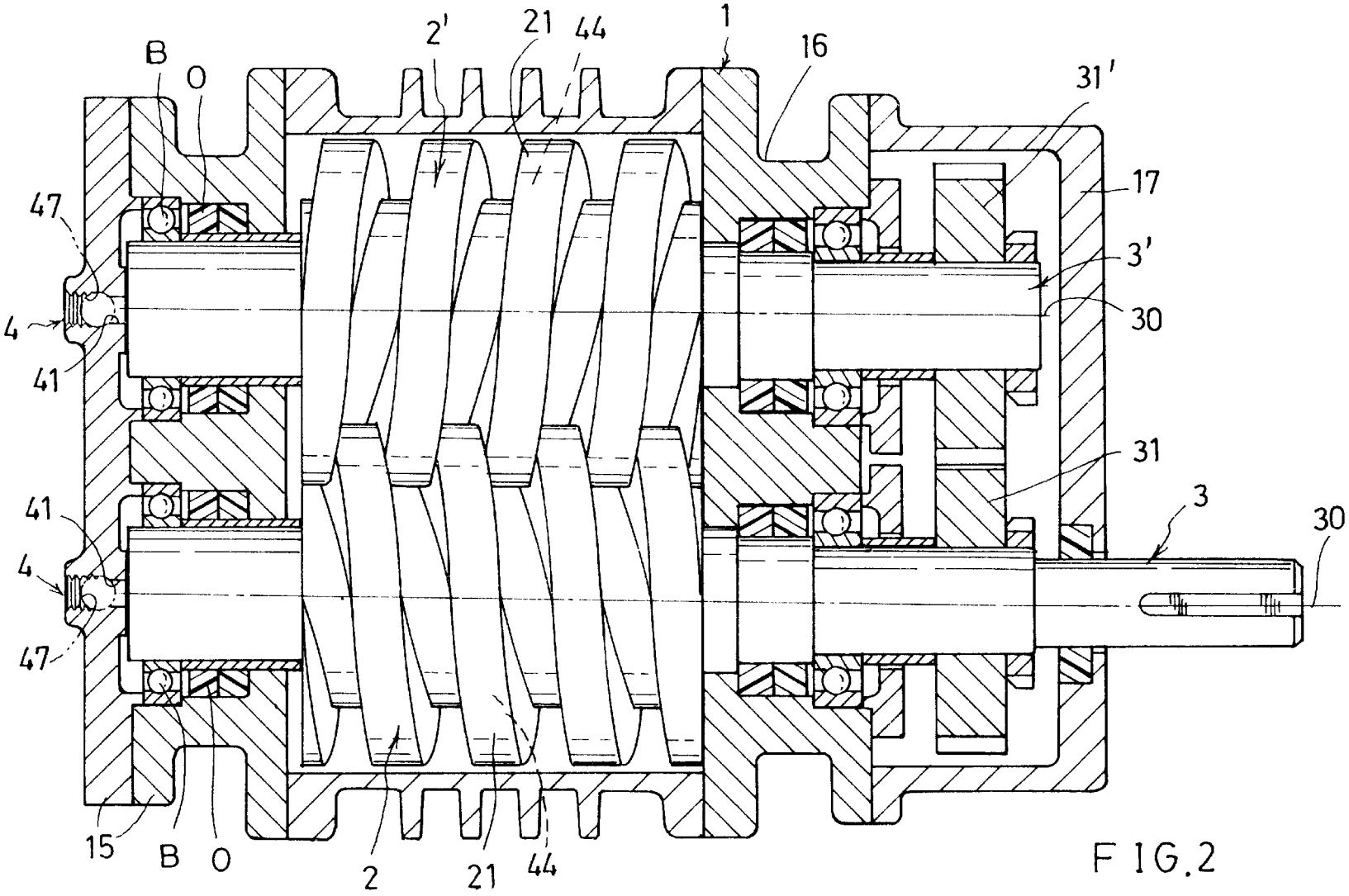
FIG. 2 is a top view of the present invention as partially cut away.

As shown in FIGS. 1–2, the rotary compression equipment of the present invention comprises: a housing 1; two intermeshing hollow rotors 2, 2' respectively secured on two shafts 3, 3' rotatably mounted in the housing 1; and two cooling means 4, 4 each formed in each rotor and each shaft for cooling the two rotors 2, 2' and shafts 3, 3' when rotated.

The rotary compression equipment of the present invention includes: a rotary compressor, a rotary blower, a rotary vacuum pump and other rotary fluid handling apparatuses.

The housing 1 includes: an inlet port 11 formed in a first portion 15 of the housing 1; a rotor chamber 12 for rotatably mounting the rotors 2, 2' therein; an outlet port 13 formed in a second portion 16 of the housing 1 having a check valve 14 formed in the outlet port 13; and a gear box 17 secured to the second portion 16 of the housing 1 for accommodating two gears 31, 31' therein. The inlet port 11 and the outlet port 13 may be vice versa, depending upon the fluid flow direction of the rotary compression equipments.

One shaft 3 is selected as a driving shaft having a driving gear 31 mounted thereon and engageable with a follower gear 31' secured on a follower shaft 3'. The two shafts 3, 3' are respectively secured with the two rotors 2, 2' meshing with each other. For gas tight or leakage prevention reason, several sealing rings or O-rings O are provided on opposite ends of each shaft. Also, bearings B are provided for rotatably mounting each shaft in the housing.

Each rotor 2 or 2' includes a helical thread 21 helically continuously formed on the rotor and each rotor is provided with O rings 20 on opposite ends of the rotor for preventing leakage of coolant flowing in the hollow rotor.

Each cooling means 4 includes: a core tube 40 secured in the first portion 15 of the housing 1; an axle coolant passage 41 longitudinally formed in the core tube 40 which is rotatably engageable in a central portion of the shaft 3 (3') having an intermediate axle passage 41' formed in the shaft and linearly connected with the axle coolant passage 41 for directing coolant such as water, oil or air into the axle passages 41, 41'; a feed conduit 42 radially connected with the intermediate axle passage 41' for feeding coolant from the axle passage 41' into a rotor coolant passage 43 concentrically and cylindrically formed in a central portion of the rotor 2 adjacent to an interface between the rotor 2 and the shaft 3 about an axis 30 of the shaft 3, and communicated with the feed conduit 42; a helical channel 44 helically continuously formed in the helical thread 21 of the rotor 2 to form a hollow portion in the helical thread 21 and communicated with the rotor coolant passage 43; a recycled conduit 45 radially formed in the shaft and connected between a peripheral passage 46 (formed in the shaft) and the rotor coolant passage 43 for recycling the coolant into the peripheral passage 46 juxtapositioned to the axle coolant passage 41 for recycling the coolant through a drain conduit 46a to a discharge passage 47 formed in the first portion 15 of the housing to be collected in a sump tank (not shown) for dissipating heat and then reboosted into the axle coolant passage 41 for next cooling operation.

The coolant passing through the axle passage 41, 41' may remove heat in the shaft 3 and the coolant in the rotor passage 43 and helical channel 44 may absorb the heat of the rotor 2 when rotatably matching with another rotor 2' due to compression for performing a heat-exchange. The heated coolant is then recycled through the conduit 45, peripheral passage 46, drain conduit 46*a*, and discharge passage 47 through a forced-draft recirculation system.

At opposite ends of the peripheral passage 46, there are provided with sealing rings O for preventing leakage of coolant or fluid.

The present invention is superior to the prior art with the following advantages:

1. The rotors 2, 2' are made as hollow rotors each having helical channel 44 formed therein for flowing coolant into the thread or tooth 21 for instantly absorbing compression heat produced from the matching threads or teeth 21 for efficiently cooling the rotors and the rotary equipment for decreasing the thermal damage.

2. The rotor is made hollow to greatly decrease the total weight of the rotary equipment, beneficial for handling, installation and maintenance.

3. The coolant may be recycled by a forced-draft recirculation system, without being limited to a vertical erection of the shaft.

4. The aperture between the rotors and the housing can be minimized due to a nice dissipation of heat by the present invention, thereby reducing the backflow of the pumping fluid and increasing the operation efficiency of the rotary equipment.

The present invention may be modified without departing from the spirit and scope of this invention.

Figure 3:
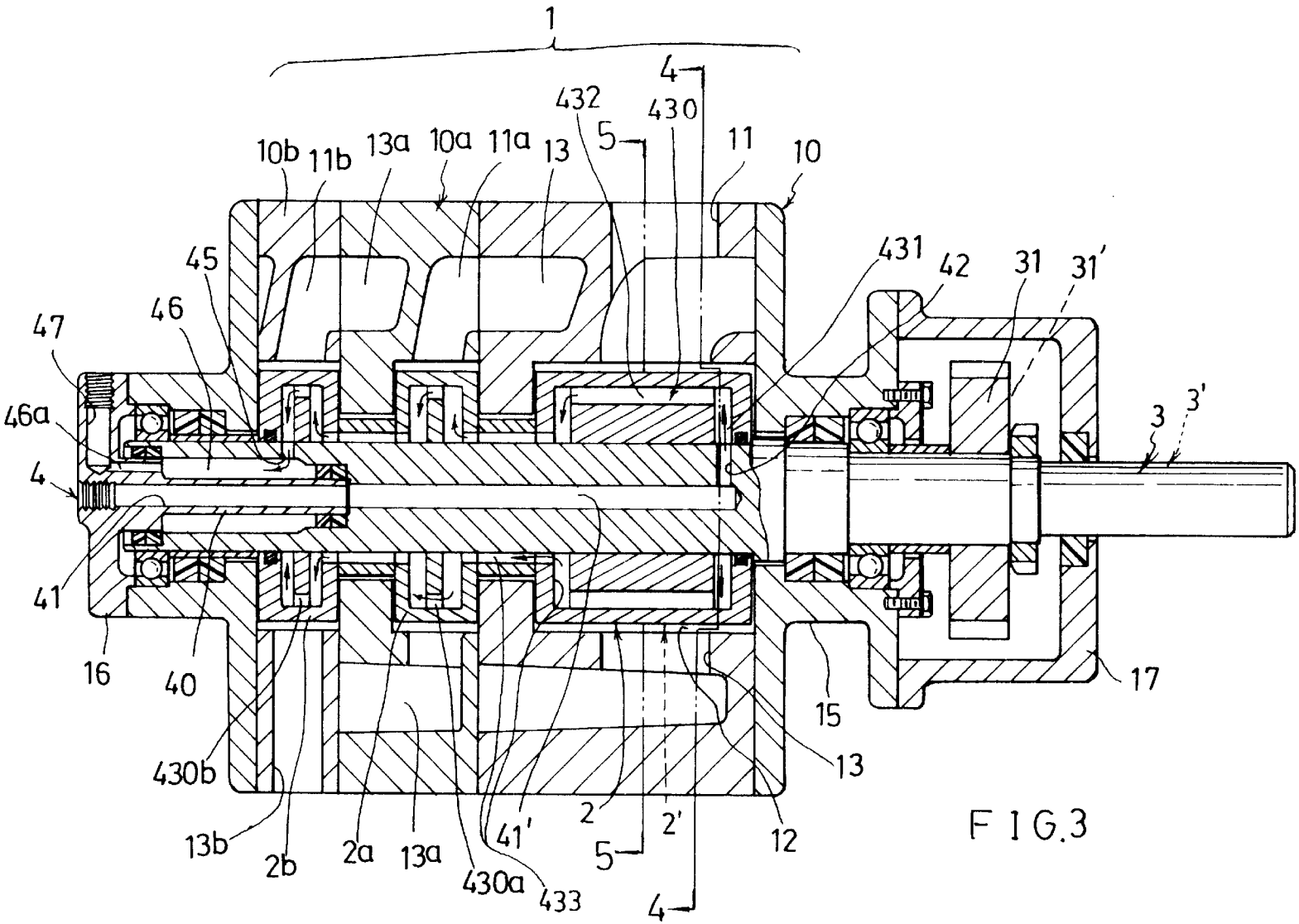
FIG. 3 is a sectional drawing of another preferred embodiment of the present invention.
Figure 4:
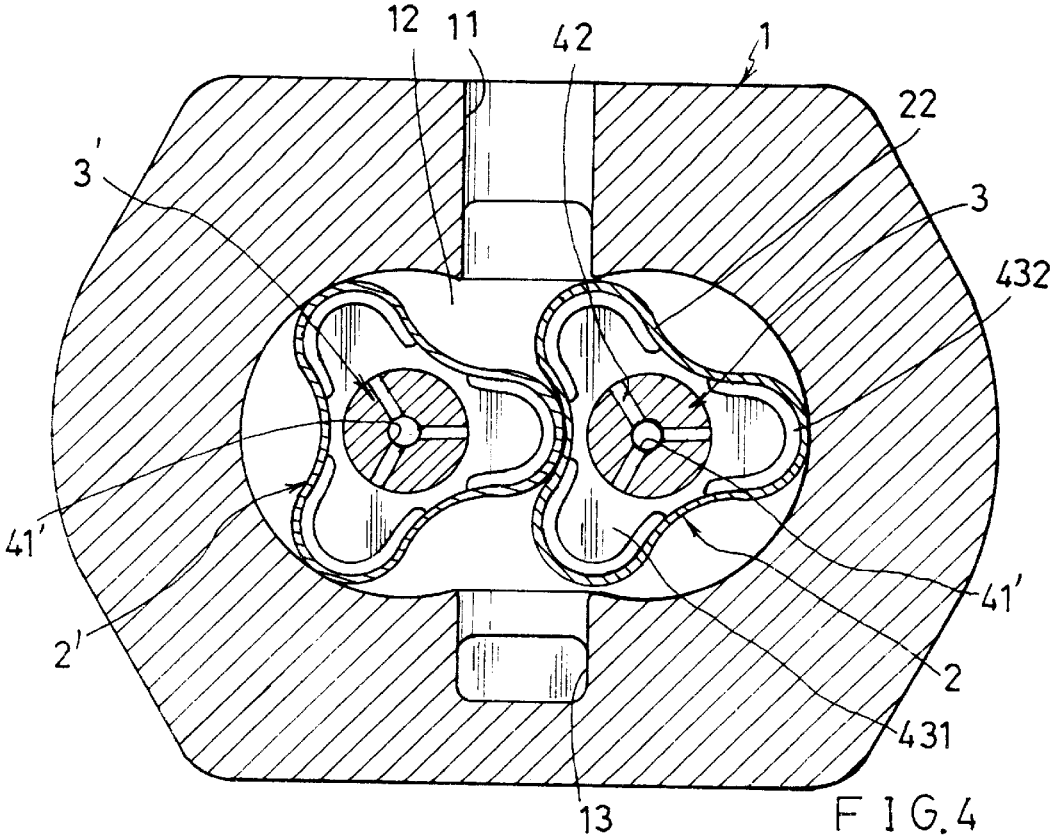
FIG. 4 is a cross sectional drawing of the present invention as viewed from 4-4 direction of FIG. 3.
Figure 5:
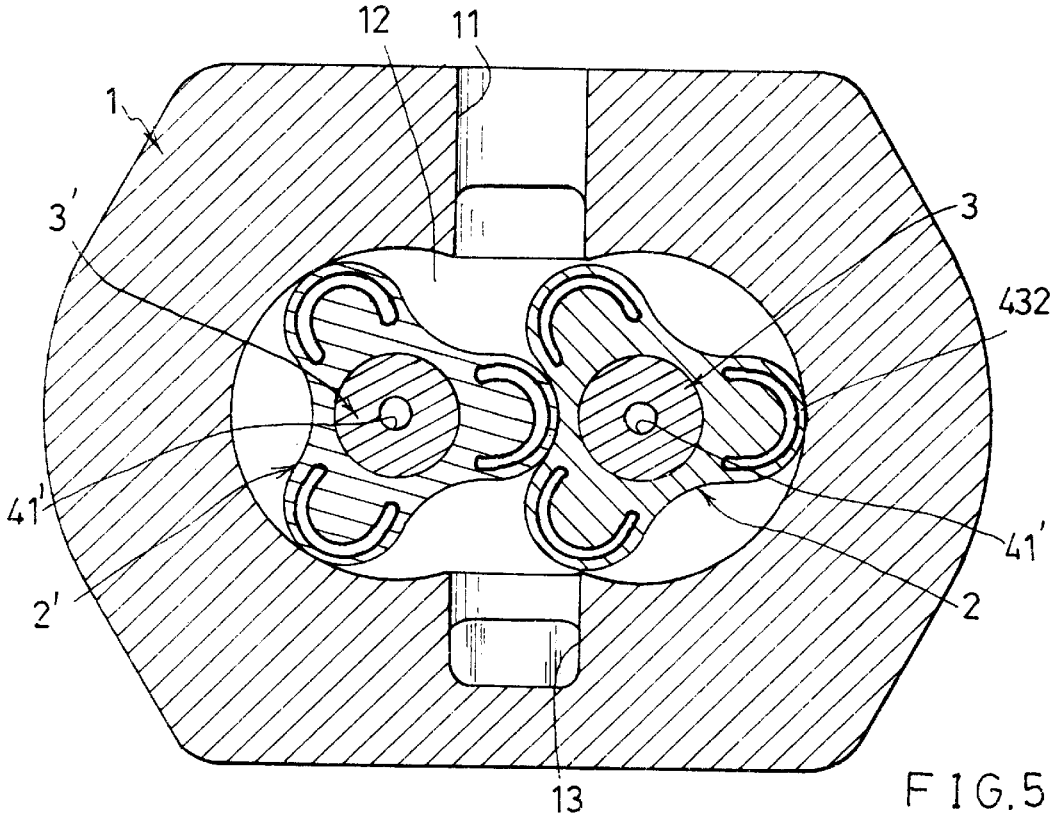
FIG. 5 is a cross sectional drawing of the present invention when viewed from 5-5 direction of FIG. 3.

Besides the screw compressor as aforementioned, the present invention may be modified to a Roots' blower or vacuum pump with single stage or multiple stages as shown in FIGS. 3–5 as described hereinafter.

As shown in FIG. 3, another preferred embodiment of the present invention comprises: a housing means 1 consisting of a first stage housing 10, a second stage housing 10*a*, and a third stage housing 10*b* connected in series for forming multiple stage of a Roots blower or vacuum pump; a driving shaft 3 and a follower shaft 3' respectively rotatably mounted in the housing means 1 each shaft passing through each housing 10, 10*a*, 10*b*; each housing 10, 10*a*, 10*b* having a rotor chamber 12 formed therein for rotatably mounting a rotor 2 having three lobes 22 in each rotor chamber 12; a driving gear 31 secured on the driving shaft 3 and a follower gear 31' secured on the follower shaft 3' and engageable with the driving gear 31, both gears 31, 31' encased in a gear box 17 attached to a first portion 15 of the housing means 1; and two cooling means 4, 4 formed in the shafts and the rotors mounted in the housing means; each cooling means 4 including a core tube 40 mounted in a second portion 16 of the housing means 1 having an axle coolant passage 41 longitudinally formed in the core tube 40 which is rotatably engageable in a central portion of the shaft having an intermediate axle passage 41' formed in the shaft and linearly connected with the axle coolant passage 41 for directing coolant into the axle passages; a least a feed conduit (or plural conduits) 42 radially formed in the shaft and connected with the intermediate axle passage 41' for feeding coolant from the axle passage 41' into a first rotor coolant passage 430 formed through a first rotor 2 rotatably mounted in the first stage housing 10; a second rotor coolant passage 430*a* formed through a second rotor 2*a* rotatably mounted in the second stage housing 10*a*; a third rotor coolant passage 430*b* formed through a third rotor 2*b* rotatably mounted in the third stage housing 10*b*; with the first, second and third rotor coolant passages fluidically communicated with one another; a recycled conduit 45 radially formed in the shaft and connected between the third rotor coolant passage 430*b* and a peripheral passage 46 formed in the shaft and juxtapositioned to the axle coolant passage 41 for recycling the coolant through a drain conduit 46*a* to a discharge passage 47 formed in the second portion 16 of the housing means 1.

The multiple (or triple) stages of the housings 10, 10*a*, 10*b* are fluidically connected in series, namely, the first stage housing 10 having an inlet port 11 and an outlet port 13; the second stage housing 10*a* having an inlet port 11*a* fluidically communicated with the outlet port 13 of the first stage housing 10, and an outlet port 13*a*; the third stage housing 10*b* having an inlet port 11*b* communicated with the outlet port 13*a* of the second stage housing 10*a*, and an outlet port 13*b* for outputing a fluid as discharged from the third stage housing 10*b*. The number of stages are not limited in this invention.

Each rotor coolant passage 430, 430*a*, 430*b* includes: a centrifugal passage 431 fluidically communicated with an upstream coolant flow passage originated from the axle coolant passage 41, a lobe passage 432 formed through at least a lobe portion 22 of the rotor 2, 2*a*, 2*b* and communicated with the centrifugal passage 431, and a centripetal passage 433 communicated between the lobe passage 432 and a downstream coolant flow passage terminated to the discharge passage 47, whereby upon flow of coolant through the centrifugal passage 431, lobe passage 432, and centripetal passage 433, the coolant will absorb the heat from each rotor and the heat will be dissipated outwardly when the coolant is discharged.

The housing means 1 as shown in FIG. 3 may be simplified to be a single stage and includes: a housing 1; two meshing triple-lobe rotors 2, 2' respectively secured on two shafts 3, 3' respectively rotatably mounted in the housing 1; and two cooling means 4, 4 each formed in each shaft and each rotor; each cooling means 4 including an axle coolant passage 41 longitudinally formed in the shaft 3 (3'), a rotor coolant passage 430 formed through the rotor 2 (2') and fluidically communicated with the axle coolant passage 41, and a discharge passage 47 fluidically communicated with the rotor coolant passage 430, whereby upon feeding of coolant through the axle coolant passage, the rotor coolant passage and the discharge passage 47, the heat in the rotor and in the shaft will be removed by the coolant by a heat exchange operation.

I claim:

1. A rotary compression equipment comprising:

a housing;

at least two intermeshing hollow rotors respectively secured on two shafts rotatably mounted in said housing; a first shaft having a driving gear engageable with a follower gear formed on a second shaft for rotating said two rotors for delivering fluid through said housing; and at least two cooling means each formed in each said shaft and each said hollow rotor for feeding a coolant through at least a coolant passage formed through said shaft and said hollow rotor for removing heat in said shaft and said rotor and dissipating heat outwardly from said housing;

each said cooling means including: a core tube secured in a portion of the housing, an axle coolant passage longitudinally formed in the core tube which is rotatably engageable in a central portion of said shaft having an intermediate axle passage formed in the shaft and linearly connected with the axle coolant passage for directing coolant into the axle coolant passage and said intermediate axle passage; a feed conduit radially connected with the intermediate axle passage for feeding coolant from the axle passage into a rotor coolant passage concentrically and cylindrically formed in a central portion of the rotor adjacent to an interface between the rotor and the shaft about an axis of the shaft, and communicated with the feed conduit; a helical channel helically continuously formed in a helical thread formed on the rotor to form a hollow portion in the helical thread and communicated with the rotor coolant passage; a recycled conduit radially formed in the shaft and connected between a peripheral passage (formed in the shaft) and the rotor coolant passage for recycling the coolant into the peripheral passage juxtapositioned to the axle coolant passage for recycling the coolant through a drain conduit to a discharge passage formed in a portion of the housing for dissipating heat outwardly.

2. A rotary compression equipment comprising:

a housing;

at least two intermeshing hollow rotors respectively secured on two shafts rotatable mounted in said housing; a first shaft having a driving gear engageable with a follower gear formed on a second shaft for rotating said two rotors for delivering fluid through said housing; and at least two cooling means each formed in each said shaft and each said hollow rotor for feeding a coolant through at least a coolant passage formed through said shaft and said hollow rotor for removing heat in said shaft and said rotor and dissipating heat outwardly from said housing;

said housing comprising: a first stage housing, a second stage housing, and a third stage housing connected in series for forming a multiple stage rotary compression equipment; each said shaft passing through each said stage housing, each said stage housing having a rotor chamber formed therein for rotatably mounting each said rotor in each said rotor chamber;

each said cooling means including a core tube mounted in a portion of the housing having an axle coolant passage longitudinally formed in the core tube which is rotatably engageable in a central portion of the shaft having an intermediate axle passage formed in the shaft and linearly connected with the axle coolant passage for directing coolant into the axle coolant passage and said intermediate axle passage; at least a feed conduit radially formed in the shaft and connected with the intermediate axle passage for feeding coolant from the axle passage into a first rotor coolant passage formed through a first rotor rotatably mounted in the first stage housing; a second rotor coolant passage formed through a second rotor rotatably mounted in the second stage housing; a third rotor coolant passage formed through a third rotor rotatably mounted in the third stage housing with said first, second and third rotor coolant passages fluidically communicated with one another; a recycled conduit radially formed in the shaft and connected between the third rotor coolant passage and a peripheral passage formed in the shaft and juxtapositioned to the axle coolant passage for recycling the coolant through a drain conduit to a discharge passage formed in the second portion of the housing means.

3. A rotary compression equipment according to claim 2, wherein each said rotor coolant passage includes: a centrifugal passage fluidically communicated with an upstream coolant flow passage originated from the axle coolant passage, a lobe passage formed through at least a lobe portion of the rotor and communicated with the centrifugal passage, and a centripetal passage communicated between the lobe passage and a downstream coolant flow passage terminated to the discharge passage, whereby upon flow of the coolant through the centrifugal passage, the lobe passage, and the centripetal passage, the coolant will absorb the heat from each said rotor and the heat will be dissipated outwardly when the coolant is discharged.

* * * * *